United States Patent [19]

Maeda et al.

[11] Patent Number: 4,677,432

[45] Date of Patent: Jun. 30, 1987

[54] DISPLAY APPARATUS

[75] Inventors: Satoru Maeda, Yamato; Kazuo Motoki, Kawasaki, both of Japan

[73] Assignee: Sony Corporation, Tokyo, Japan

[21] Appl. No.: 662,301

[22] PCT Filed: Jan. 27, 1984

[86] PCT No.: PCT/JP84/00020

§ 371 Date: Sep. 27, 1984

§ 102(e) Date: Sep. 27, 1984

[87] PCT Pub. No.: WO84/02996

PCT Pub. Date: Aug. 2, 1984

[30] Foreign Application Priority Data

Jan. 28, 1983 [JP] Japan ..... 58-12297

[51] Int. Cl.[4] ..... G09G 1/16

[52] U.S. Cl. ..... 340/728; 340/801; 340/750

[58] Field of Search ..... 340/728, 750, 726, 798, 340/799, 801

[56] References Cited

U.S. PATENT DOCUMENTS 4,486,856 12/1984 Heckel et al. ..... 340/799 X 4,544,922 10/1985 Watanabe et al. ..... 340/728

4,546,349 10/1985 Prohotsky et al. ..... 340/750 X

*Primary Examiner*—Marshall M. Curtis

*Attorney, Agent, or Firm*—Lewis H. Eslinger

[57] ABSTRACT

Display data is read out from a display memory (2) and the display data thus read out is written in the buffer memory (8). Then, in a time sharing manner relative to the writing, the display data is read out from the buffer memory (8), and a smoothing processing is carried out on the basis of the display data thus read out and the display data read out from the display memory (2).

2 Claims, 11 Drawing Figures

DISPLAY APPARATUS

TECHNICAL FIELD

This invention relates to a technique suitable for use in a display apparatus such as teletext, videotex and the like by which when a display dot of reference size is added with a smaller display dot than the former so as to make a display pattern easy to see, the latency time of a CPU can be reduced.

BACKGROUND ART

In a television broadcasting, a television character multiplexing broadcasting is proposed in which the vertical blanking period of a main television program is utilized to broadcast various kinds of information such as news, weather forecast, notice and so on.

In a receiver for receiving such broadcast, the display apparatus thereof is constructed as shown in FIG. 1.

In FIG. 1, when a pattern data to be displayed is received, this display pattern data is processed by a CPU 1 and then written in a pattern memory 2. In this pattern memory 2, its addresses Axy are schematically shown in response to a display picture screen as shown in FIG. 1. In this case, a horizontal address (address in the horizontal direction) Ax corresponds to the horizontal scanning position of the display picture screen, while a line address (address in the vertical direction) Ay corresponds to the vertical scanning position, or the horizontal line (scanning line), wherein $$Axy = a \cdot Ay + Ax$$

is established in which a corresponds to the lateral width of the display picture screen and for example, $$a = 32$$

Each bit of the memory 2 corresponds to each dot of a display pattern and a bit having level "1" is displayed as a dot (bright point).

A control circuit 6 generates an address signal which designates the horizontal address Ax, namely, a horizontal address signal HAS which is incremented one by one for every one byte (8 bits) of the pattern data in synchronism with the horizontal scanning and also an address signal which designates the line address Ay, namely, a line address signal LAS which is incremented one by one at every one horizontal scanning. By these address signals HAS and LAS, the memory 2 is addressed and pattern data is read out one byte by one byte from the address corresponding to the scanning position of the display picture screen.

The pattern data thus read is loaded in parallel one byte by one byte to a shift register 3 and then serially derived one bit by one bit therefrom. The pattern data thus derived is supplied to a CRT display 5. Accordingly, displayed on the screen of the CRT display 5 is a pattern which corresponds to the bit image of the memory 2.

By the way, when such display is carried out, in order to make such displayed pattern easy to see, it is proposed to carry out smoothing (rounding) in, for example, published Japanese patent application No. 41016/1978.

FIG. 2 schematically shows an example of a pattern data of a character "A" written in the pattern memory 2. In this pattern data, the hatched bits represent level "1", while the bits without hatching represent level "0".

FIG. 3 shows the character "A" which is displayed on the screen of the CRT display 5, in which no smoothing is carried out. Reference numerals $L_1$ to $L_{14}$ designate lines (scanning lines) in which the lines shown by solid lines are formed during the odd field periods, while the lines shown by broken lines are formed during the even field periods. Reference letter Du designates a dot having a fundamental size. Since the pattern data (FIG. 2) of the memory 2 is used during both the odd and even field periods, the display pattern becomes as shown in the figure.

On the contrary, when the smoothing is carried out, the character "A" is displayed as shown in FIG. 4, in which a half dot Dh having a width ½ the original dot Du is added. Accordingly, as compared with the character "A" which is not subjected to the smoothing as shown in FIG. 3, this character becomes smooth and easy to see.

When this smoothing is carried out, the combination of the half dot Dh with the unit dot Du can exist only in two ways as shown in FIG. 5, and in all patterns, the half dot Dh is added to the unit dot in the combinations shown in FIG. 5. That is, when the two unit dots Du are arranged in the oblique direction, the two half dots Dh are added in the direction intersecting the above oblique direction.

Accordingly, when the smoothing processing is carried out, during the odd field period the pattern data on the line (the line address Ay of the memory 2 is n address) which is currently displayed and the pattern data on the preceding line ($Ay=n-1$) are required, while during the even field period, the pattern data on the line ($Ay=n$) which is currently displayed and the pattern data on the succeeding line ($Ay=n+1$) are necessary.

For this reason, when the smoothing is carried out, the access of the pattern data for the pattern memory 2 is generally carried out as shown in FIG. 6.

FIG. 6 shows a certain horizontal period, in which Tb represents the horizontal blanking period, Th the horizontal display period (horizontal scanning period) and Tp a period which corresponds to the lateral width of the pattern data of one byte (see FIG. 1). The horizontal address Ax (the signal HAS) is incremented one address by one address at every period Tp in response to the horizontal scanning position, while the line address Ay (the signal LAS) is designated as n' address in the former half period Tpf of the period Tp and n address in the latter half period Tpb thereof, in which n represents the line address Ay (=n) corresponding to the line which is currently displayed and n' is represented as:

$$n' = n-1 \ldots \text{odd field period}$$

$$n' = n+1 \ldots \text{even field period}$$

In consequence, from the memory 2 during the latter half period Tpb, derived is the pattern data (hereinafter simply called "display data DD") on the line ($Ay=n$) which is currently displayed and during the first half period Tpf, the pattern data (hereinafter called "comparing data DR") on the preceding or succeeding line ($Ay=n-1$ or $Ay=n+1$).

These data DD and DR are loaded to shift registers 3D and 3R as shown in FIG. 7 and then made simultaneous. Then, the data DD and DR thus made simultaneous to each other are subjected to the smoothing process by a processing circuit 4 from which a luminance signal having the half dot Dh as shown in FIG. 5 is produced and which then is delivered to the CRT display 5.

However, in such smoothing processing, the memory 2 is always addressed by the control circuit 6 for reading during the period Th so that the CPU 1 can access the memory 2 only during the period Tb, or the latency time of the CPU 1 becomes long, thus the apparent processing speed and processing ability of the CPU 1 being lowered, which is inconvenient.

If the period (Tpf +Tpb) is made shorter than the period Tp, the CPU 1 can access the memory 2 during the remaining period. To this end, this processing requires the memory 2 of extremely high speed which is difficult to be realized. If such high speed memory is realized, it becomes very expensive.

In order to obtain the comparing data DR, the line address Ay indicated by the line address signal LAS must be n' address which is displaced by one address from n address and its value n' becomes different in the displacing direction depending on the odd field period and even field period, it is necessary to provide a complex address converting circuit.

Therefore, it is an object of this invention to provide a display apparatus capable of reducing the latency time of the CPU in the smoothing processing and which is free from the increase of the cost.

DISCLOSURE OF INVENTION

In the present invention, as, for example, shown in FIG. 8, there is provided a buffer memory 8 having a capacity of one line, whereby during the period Tpb in the period Tp, pattern data is read out from the pattern memory 2 and this pattern data is written in the buffer memory 8, while during the period Tpf in the period Tp, the pattern data is read out from the buffer memory 8. Then, the smoothing processing is carried out on the basis of the pattern data read out from the pattern memory 2 during the period Tpb and the pattern data read out from the buffer memory 8 during the period Tpf.

Consequently, since the CPU 1 can access the memory 2 during the period Tpf, it is possible to reduce the latency time of the CPU 1 considerably.

Further, the memory 2 may be the same as those in FIGS. 6 and 7 and requires no special memory having a high operation speed, thus avoiding the increase of the cost.

BEST MODE FOR CARRYING OUT THE INVENTION

Figure 8:
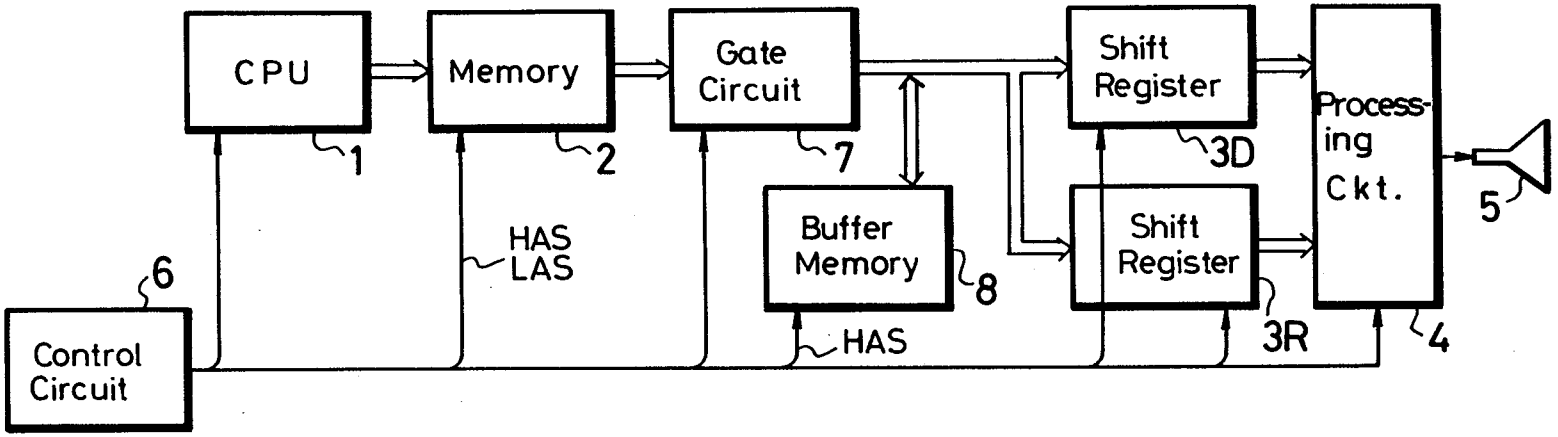
FIG. 8 is a systematic block diagram of an embodiment of a display apparatus according to this invention.

FIG. 8 shows an embodiment of this invention. A three-state gate 7 is provided in the data bus between the memory 2 and shift registers 3D and 3R. Connected to the data bus between this gate 7 and the registers 3D and 3R is the buffer memory 8 and the horizontal address signal HAS is supplied to this memory 8. This memory 8 has a capacity of one line of the memory 2 (capacity corresponding to one line of a pattern to be displayed).

As shown in FIG. 9, while the line address Ay indicated by the line address signal LAS is incremented one by one at every horizontal scanning period in response to the vertical scanning position, it is not changed (changed to n and n' in FIG. 6) during one horizontal display period Th. Further, during the even field period, the value n of this line address Ay begins to increment at timing prior to the odd field period by one horizontal period so that during the horizontal display period Th of the even field period corresponding to the horizontal display period Th in which the value n is presented during the odd field period, the value is changed to (n+1).

Figure 10:
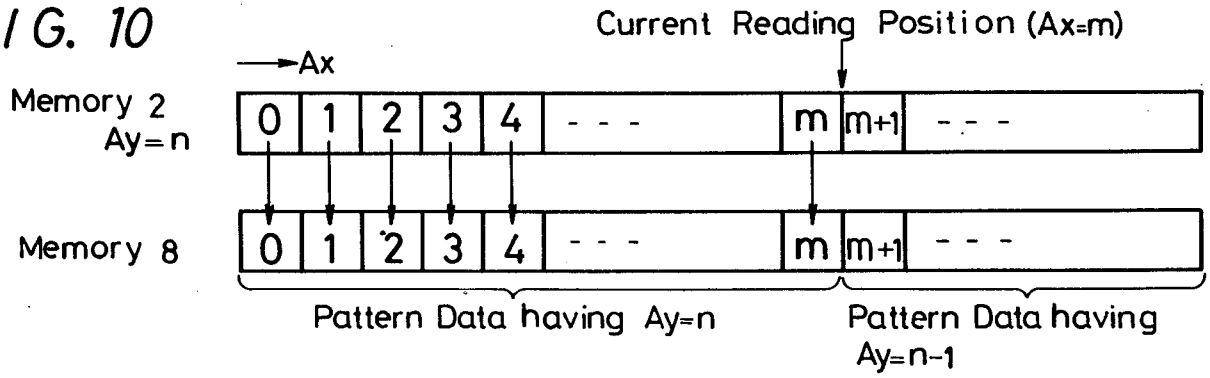

Then, as shown in FIG. 9, during the latter half period Tpb of the period Tp in which Ax=m is established in the horizontal display period Th in which Ay=n is established, the pattern data at Amn address (Ax=m and Ay=n) of the memory 2 is read out and the pattern data thus read out is written through the gate 7 in the buffer memory 8 at its m address as shown in FIG. 10.

Accordingly, at the end timing of the period Tp in which Ax=m is established in the horizontal display period Th in which Ay=n is established, as shown in FIG. 10, of the pattern data stored in the memory 2, pattern data having Ay=n and Ax=0 to m is written at the 0 to m addresses of the memory 8 so that pattern data (pattern data on one line) of the memory 2 in which Ay=(n−1) and Ax>m are established remains at the addresses followed by (m+1) address of the memory 8. Then, at the end of the horizontal display period Th in which Ay=n is established, pattern data (pattern data of one line) of Ay=n stored in the memory 2 has been written in the memory 8.

Figure 9A:
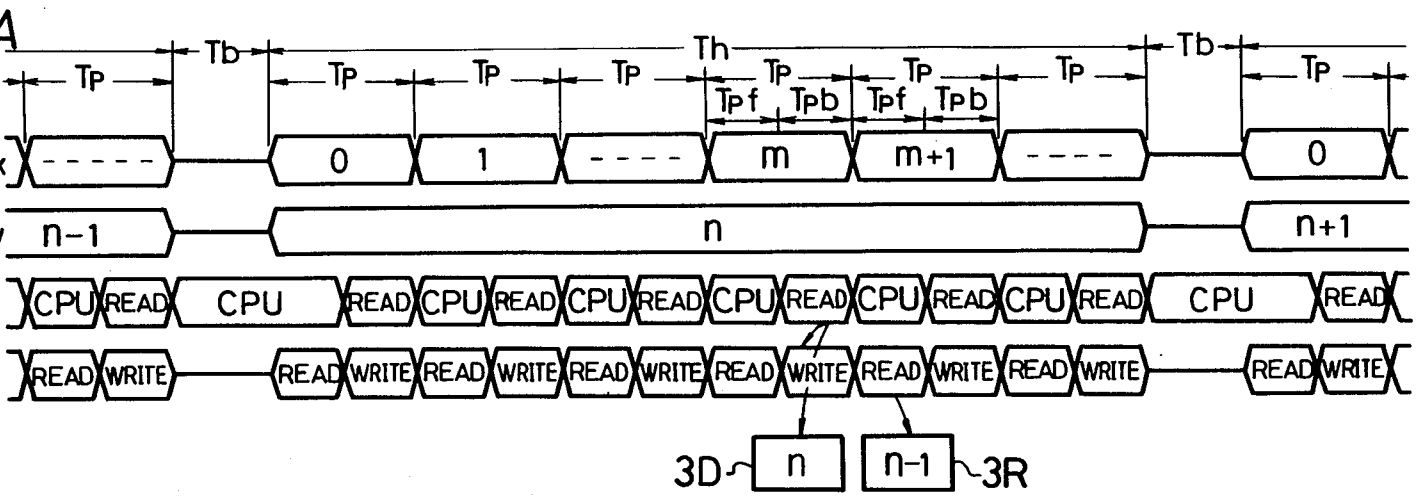

During the odd field period, as described above, in the period Tpb of the period Tp in which Ay=n and Ax=m are established, pattern data is read out from Amn address (Ax=m and Ay=n) of the memory 2 and written in the m address of the memory 8. At the same time, as shown in FIG. 9A, that pattern data is loaded in the shift register 3D, and during the period Tpf in the succeeding period Tp in which Ax=(m+1) is established, pattern data is read out from the (m+1) address of the memory 8 and this pattern data is loaded to the shift register 3R. In this case, while the pattern data loaded to the register 3D is the pattern data in which Ay=n is established as set forth above, the pattern data loaded to the register 3R is the pattern data on the preceding line in which Ay=(n−1) is established. As a result, the display data DD is loaded to the shift register 3D, while the compared data DR is loaded to the shift register 3R.

Figure 7:
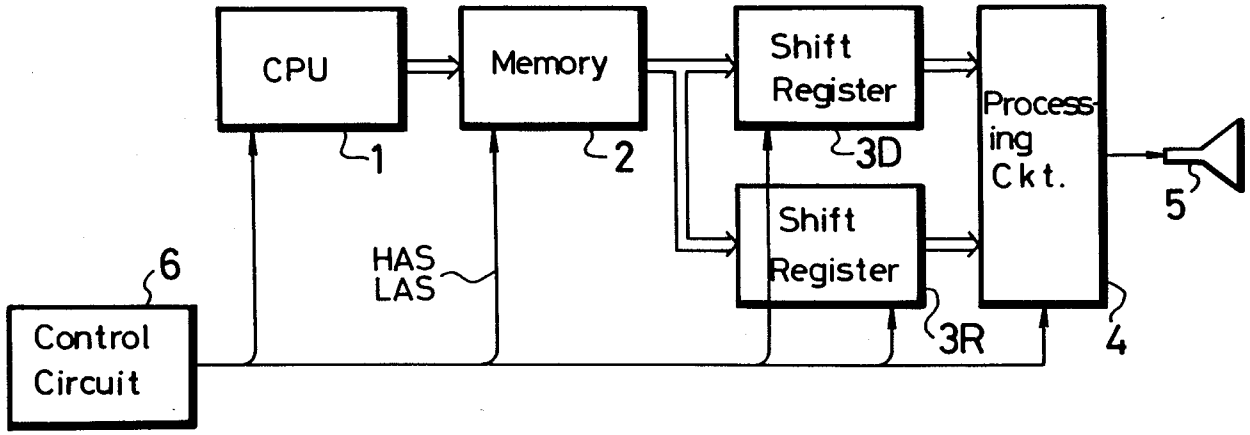

Then, the data DD and DR of the registers 3D and 3R are subjected to the smoothing processing in the processing circuit 4 similarly to FIG. 7 so that the luminance signal having half dots Dh is supplied to the CRT display 5.

Figure 9B:
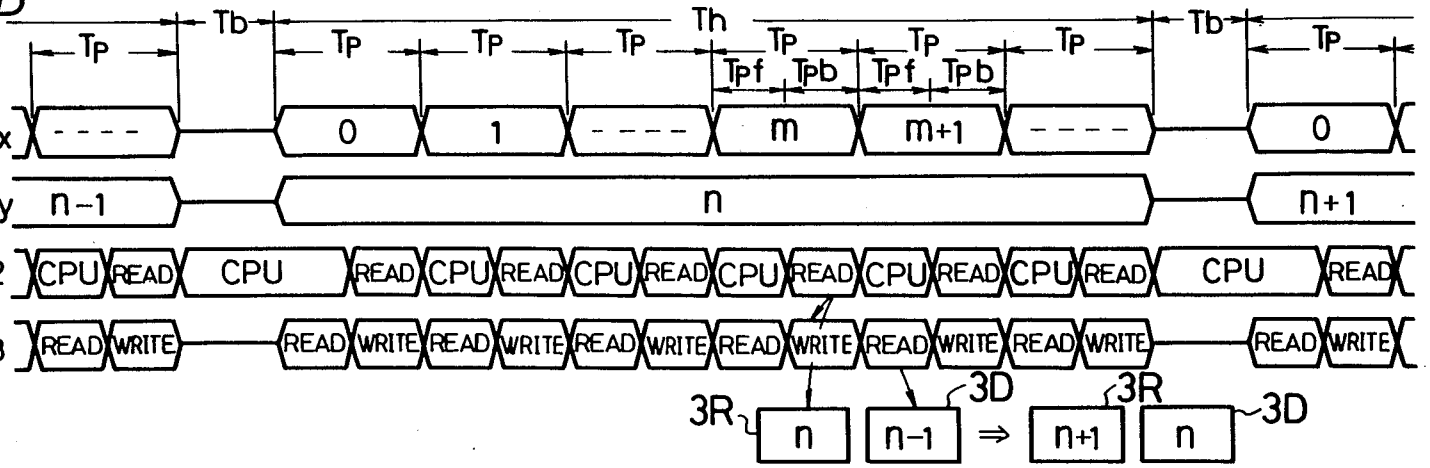

Further, during the even field period, as shown in FIG. 9B, the similar processing to that during the odd field period is carried out. During this even field period, however, the pattern data read out from the memory 2 is loaded to the shift register 3R and the pattern data read out from the memory 8 is loaded to the shift register 3D.

In this case, during the even field period, the line address Ay is larger by one than that during the odd field period and the value n of the even field period corresponds to the value (n+1) of the odd field period so that the pattern data having Ay=(n−1) and that having Ay=n loaded in the shift registers 3D and 3R are equal to the pattern data having Ay=n and that having Ay=n+1 of the odd field period. That is, the display data DD and the compared data DR are loaded in the shift registers 3D and 3R, too.

Accordingly, the processing circuit 4 produces the luminance signal having the half dot Dh which then is supplied to the CRT display 5.

As mentioned above, during the period Tpb in the period Tp, the pattern data is read out from the pattern memory 2, while during the period Tpf, the pattern data is read out from the buffer memory 8, thus the smoothing processing being carried out.

In this case, during the period Tpf in the period Tp, the memory 2 is disconnected from the memory 8 and the shift registers 3D and 3R by the gate 7, so during this period Tpf, the CPU 1 accesses the memory 2.

As described above, in accordance with this invention, since during the period Tpb of the period Tp, the pattern data is read out from the pattern memory 2 and during the period Tpf, the pattern data is read out from the buffer memory 8 to thereby carry out the smoothing processing, the CPU 1 can access the memory 2 during the period Tpf, thus reducing the latency time of the CPU 1 considerably.

Figure 6:
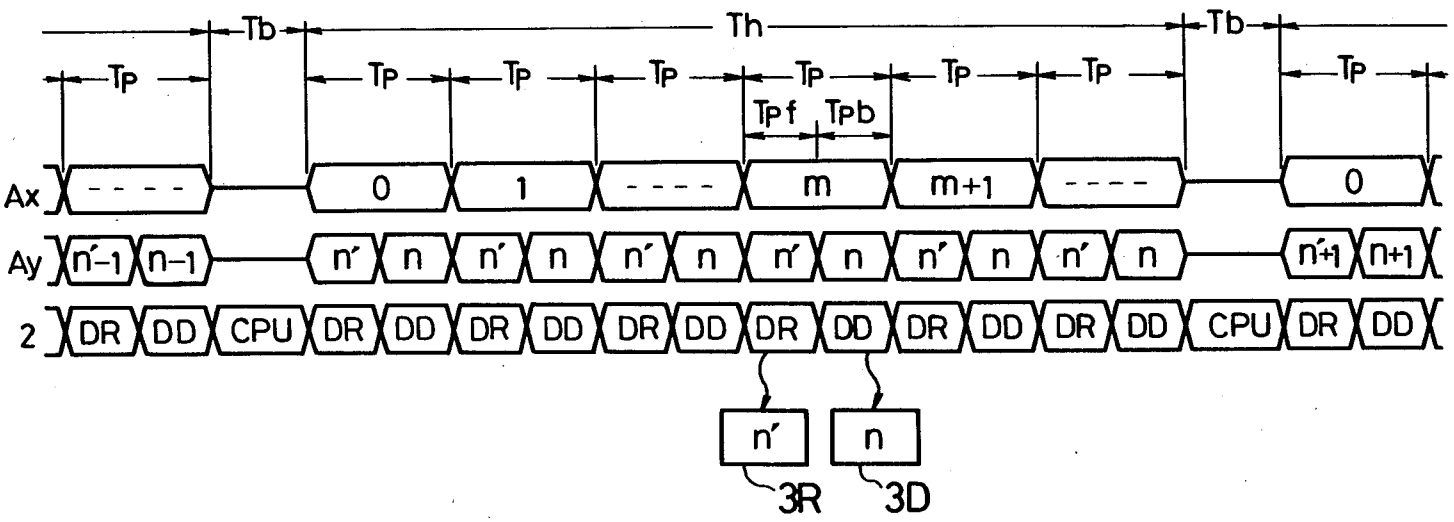

Further, the memory 2 may be the same one as those in FIGS. 6 and 7 and requires no special memory having a high operation speed, thus avoiding the increase of the cost.

In the above embodiment, the bit image of the pattern data stored in the memory 2 is displayed on the CRT display 5. When a character code is written in the memory 2 as the display data and this character code is fed to a character generator so as to display the corresponding character, such character generator may be provided on the bus line connecting the gate 7, the memory 8 and the shift registers 3D and 3R.

In any one of the field periods, the pattern data from the memory 2 is loaded in the shift register 3D and the pattern data from the memory 8 is loaded in the shift register 3R. Also, during the odd field period, the pattern data of the shift register 3D is taken as the display data DD and the pattern data of the shift register 3R is taken as the compared data DR while during the even field period, the pattern data of the shift register 3D is taken as the compared data DR and the pattern data of the shift register 3R is taken as the display data DD, whereby the smoothing processing may be carried out.

Figure 1:
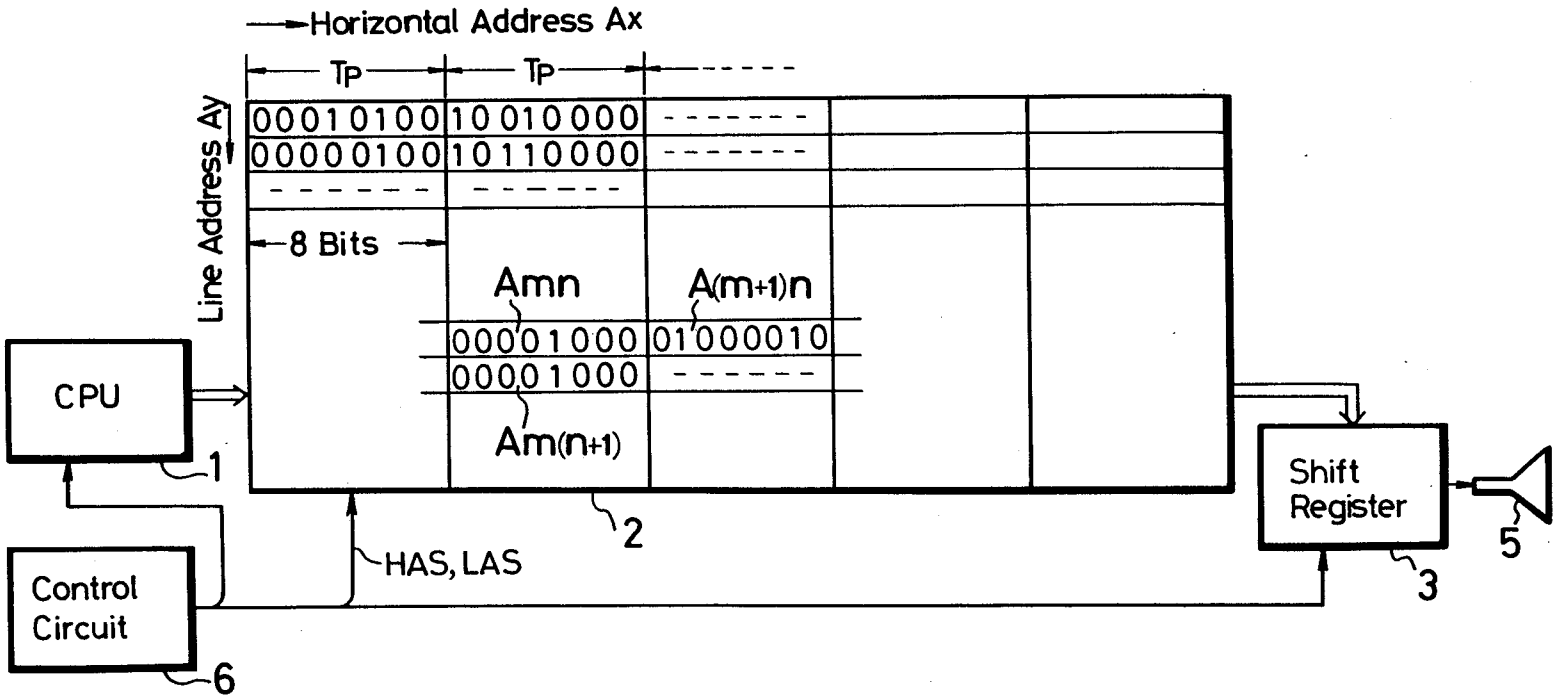
FIGS. 1 to 7 and FIGS. 9A, 9B and 10 are diagrams useful for explaining this invention
Figure 2:
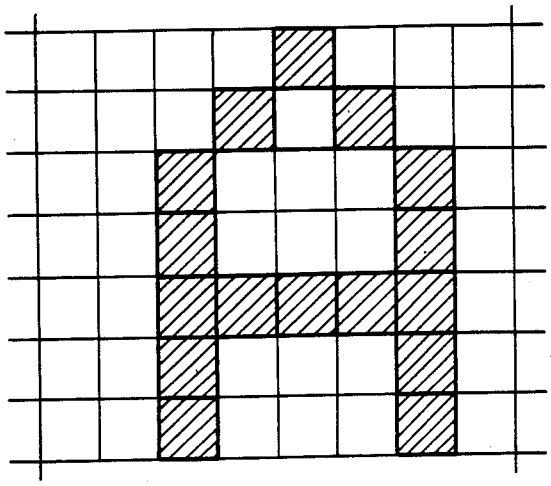
Figure 3:
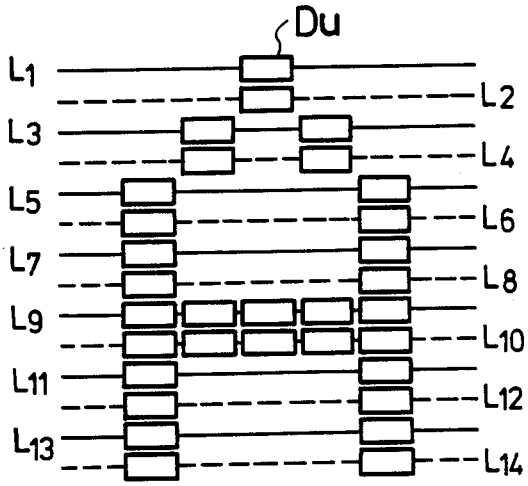
Figure 4:
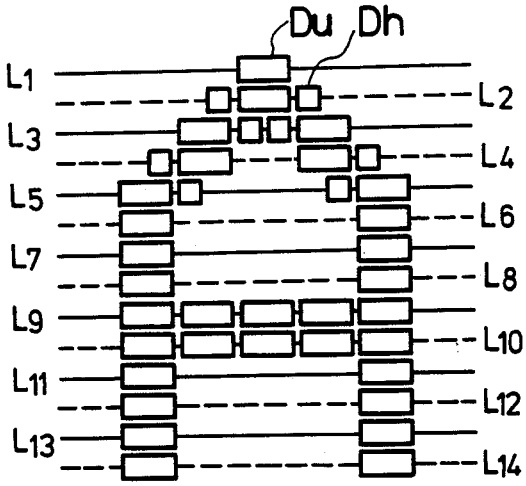
Figure 5:
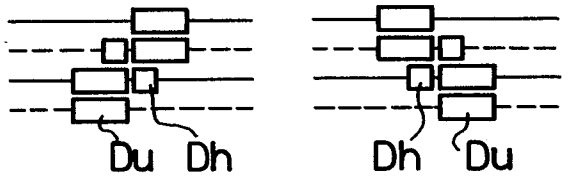

In addition, the format for the smoothing processing is not limited to the example shown in FIG. 5.

We claim:

1. A display apparatus of the kind for displaying data on a screen during horizontal and vertical scanning thereof and including a display memory in which display data is recorded and a processing circuit including first and second shift registers for smoothing a display formed of display elements of selected sizes and which carries out smoothing processing based upon a pair of predetermined data being read out from said display memory, said display apparatus further comprises a central processing unit connected for selectively accessing said display memory, a buffer memory of one horizontal scanning line amount, in which each horizontal scanning line includes a plurality of data periods and during a first portion of each data period the display data read out from said display memory is written in said buffer memory and in one of said first and second shift registers, while during a second portion of each data period which does not overlap said first portion, said display data is read out from said buffer memory and stored in the other of said first and second shift registers, in which said display data read out from said buffer memory and said display data read out from said display memory have a time difference of one horizontal scanning period therebetween and control means for controlling operation of said display memory, said buffer memory, and said processing circuit including said first and second shift registers, whereby the processing for smoothing a display is carried out using said display data read out from said first shift register and said display data read out from said second shift register, and said central processing unit accesses said display memory during said second portion of a data period.

2. A display apparatus according to claim 1, wherein said first portion of a data period is a latter half period of a data period corresponding to a lateral width of a character displayed by display data of one byte and said second portion of a data period is a former half period of said data period corresponding to said lateral width of said character displayed by said display data of one byte.

* * * * *